US005346637A

United States Patent [19]

Horodysky et al.

[11] Patent Number: 5,346,637

[45] Date of Patent: Sep. 13, 1994

[54] ANTIWEAR ADDITIVES

[75] Inventors: Andrew G. Horodysky, Cherry Hill, N.J.; Shi-Ming Wu, Newtown, Pa.

[73] Assignee: Mobil Oil Corporation, Fairfax, Va.

[21] Appl. No.: 991,614

[22] Filed: Dec. 16, 1992

[51] Int. Cl.[5] ..... C10M 137/00

[52] U.S. Cl. ..... 252/49.9; 560/192; 560/196; 560/230

[58] Field of Search ..... 252/49.9; 560/192, 196, 560/230

[56] References Cited

U.S. PATENT DOCUMENTS

| | | | |
|---|---|---|---|
| 3,513,093 | 5/1970 | LeSuer | 252/49.9 |
| 4,185,485 | 1/1980 | Schick et al. | 560/196 |
| 4,193,883 | 3/1980 | Frangatos | 252/49.9 |
| 4,196,090 | 4/1980 | Lilburn | 252/49.9 |
| 4,229,310 | 10/1980 | Frangatos | 252/49.9 |
| 4,234,435 | 11/1980 | Meinhardt et al. | 252/47.5 |
| 4,582,926 | 4/1986 | Straehle et al. | 560/192 |
| 4,960,529 | 10/1990 | Horodysky et al. | 252/32.5 |
| 4,965,002 | 10/1990 | Brannen et al. | 252/49.9 |
| 5,164,103 | 11/1992 | Papay | 252/49.9 |

FOREIGN PATENT DOCUMENTS 456888 11/1991 European Pat. Off. .

*Primary Examiner*—Ellen M. McAvoy
*Attorney, Agent, or Firm*—Alexander J. McKillop; Malcolm D. Keen; Jessica M. Sinnott

[57] ABSTRACT

A multifunctional antiwear and antioxidant lubricant additive is the reaction product of a diacyl halide, a source of phosphorus or a source of phosphorus and an aryl amine. The diacyl halide is derived from a hydrocarbon-substituted succinic anhydride, suitably dodecenyl succinic anhydride, an alkoxylated amine and an inorganic acid halide, suitably thionyl chloride. A suitable source of phosphorus is dibutyl phosphite or bis(-nonylphenyl)phosphite. A suitable aryl amine is N-octylphenyl-1-naphthylamine.

25 Claims, No Drawings

ANTIWEAR ADDITIVES

FIELD OF THE INVENTION

The invention is directed to a lubricant additive having antiwear and antioxidant properties. Specifically, the invention is directed to a reaction product of a diacyl halide, derived from a succinic ester-acid and a halogenating agent, and a source of phosphorus or source of phosphorus and arylamine.

BACKGROUND OF THE INVENTION

Mechanical systems under heavy loads will deteriorate due to the frictional forces created by relatively moving, rubbing and bearing metal surfaces. Often, lubricants for such operations cannot prevent wear of the metal or reduce the coefficient of friction and, as a result, the system performance is affected. Often, antiwear additives, load carrying and friction modifying additives are blended with lubricants in order to prevent wear, reduce fuel consumption and increase the operating life of the machinery.

Lubricants such as lubricating oils and greases are known to undergo oxidative deterioration upon exposure to elevated temperatures. Oxidative deterioration causes an increase in the acidity and viscosity of the lubricant. Acidity causes corrosion of metal parts exposed to the lubricant and high viscosities cause the lubricant to thicken and lose its lubricating ability. These problems can eventually lead to mechanical failure. Antioxidants are incorporated into lubricants to prevent oxidation.

In U.S. Pat. No. 4,960,529 a reaction product of a diacyl halide, an amine and a phosphite is described as having antioxidant and antiwear properties in lubricants. The diacyl halide is derived from an aliphatic dicarboxylic acid, i.e. decanedicarboxylic acid and thionyl chloride.

U.S. Pat. No. 4,229,310 discloses a reaction product of a partially esterified alcohol with a phosphorus oxyhalide or a trihydrocarbyl phosphate. The reaction product is described as having improved demulsifying and antiwear properties in lubricants.

U.S. Pat. No. 4,234,435 discloses reacting a carboxylic acid acylating agent with a polyoxyalkylene polyamine to produce an acylated amine, which is further reacted with one or more reactants which include a sulfur chloride and a hydrocarbyl phosphite.

Alkenylsuccinic anhydrides are known for their lubricity and solubility properties in lubricants. Imide derivatives of alkenylsuccinic anhydrides have been known for their detergent and dispersancy properties.

SUMMARY OF THE INVENTION

The invention offers an improvement in the lubricity and dispersancy/detergency properties of phosphorus-containing reaction products by the incorporation of a diacyl halide as a backbone for a phosphorus antiwear functionality and, optionally, an arylamine antioxidant functionality.

The invention is directed to a reaction product of a diacyl halide, derived from a succinic ester-acid and a halogenating agent, a source of phosphorus or a source of phosphorus and an arylamine. The invention is further directed to lubricant compositions comprising the reaction product for purposes of enhancing the antiwear and antioxidant properties of the lubricant.

Additional likely features include thermal stabilizing, extreme pressure, antifatigue, anticorrosion, demulsive/emulsive, friction reducing and fuel economy improving properties.

DETAILED DESCRIPTION OF THE INVENTION

The invention is directed to a reaction product comprising a diacyl halide, derived from a succinic ester-acid and a halogenating agent, a source of phosphorus or a source of phosphorus and an amine. The invention is also directed to a lubricant composition comprising a major proportion of a lubricant and a minor antioxidant and antiwear amount of an additive product comprising a reaction product of a diacyl halide, derived from a succinic ester-acid and a halogenating agent, a source of phosphorus or source of phosphorus and an arylamine and methods of making a lubricant composition.

The succinic ester-acid starting material can be prepared from a hydrocarbon substituted succinic acylating agent and a alkoxylated amine. In a specific embodiment, the amine is free of active amino-hydrogen.

The hydrocarbon-substituted succinic anhydride is represented by the structural formula:

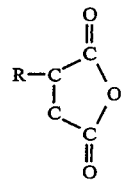

where R is a hydrocarbon group containing from about 1 to 300 carbon atoms, preferably 6 to 150 carbon atoms, more preferably from about 6 to 30 carbon atoms. The hydrocarbon group is, preferably, an aliphatic alkyl group which can be saturated or unsaturated, straight chain, branched or cyclic.

The hydrocarbon-substituted succinic anhydride can be derived from a condensation reaction between an olefin and maleic anhydride. Suitable olefins include ethylene, propylene, butylene, isobutylene, pentene, hexene, heptene, octene, nonene, decene, dodecene, eicosene, higher olefinic hydrocarbons as well as polymers and copolymers made from any of the foregoing olefins. The olefin can also contain cyclic hydrocarbon groups such as phenyl, naphthyl or alicycle. The hydrocarbon group can contain at least one heteroatom which is a nitrogen atom, sulfur atom or oxygen atom. In order for the final product to have the solubility properties necessary for beneficial emulsivity in lubricants, the hydrocarbon group should have an average molecular weight ranging from 140 to 3000, preferably from 140 to 2500, more specifically from 140 to 2000.

The hydrocarbon-substituted succinic anhydride is reacted to form the ester-acid, more specifically, an ester-carboxylic acid, by reaction with an alkoxylated amine, specifically, an alkoxylated amine which is free of an active amino-hydrogen atom. Alkoxylated amines represented by the following structures are suitable for the preparation of the ester-acid:

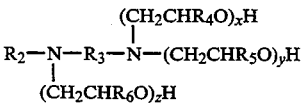

-continued and

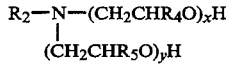

where $R_2$ is hydrogen or a hydrocarbon group containing from about 1 to 100 carbon atoms, preferably from about 4 to 50 carbon atoms and optionally, at least one heteroatom which is oxygen, sulfur and/or nitrogen contained within the hydrocarbon chain. $R_3$ is a hydrocarbon group containing 3 to 25 carbon atoms. $R_4$, $R_5$ and $R_6$ are hydrogen or the same or different hydrocarbon group containing about 1 to 60 carbon atoms, preferably from about 1 to 20 carbon atoms, x is an integer ranging from about 0 to 20, preferably about 1 to 10, y is an integer ranging from about 0 to 20, preferably about 1 to 10, z is an integer ranging from about 0 to 20, preferably from about 1 to 10; however, $x+y+z$ must equal at least 1, preferably at least 2. When any of $R_2$, $R_3$, $R_4$, $R_5$ and $R_6$ are hydrocarbon groups, they can be any straight or branched chain aliphatic or olefinic hydrocarbon group including, methyl, ethyl, propyl, butyl, isobutyl, pentyl, hexyl, heptyl octyl, decyl, dodecyl, and higher hydrocarbons including any polymers and copolymers thereof. Specific suitable alkoxylated amines include etheramines, and etherdiamines represented by the structures:

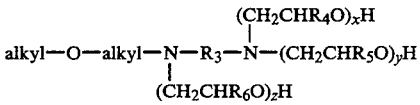

(etherdiamine)

or

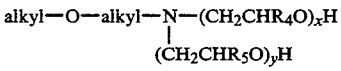

(etheramine)

The hydroxyl groups of the amine react with the anhydride to form an ester group and an acid group, or, more specifically, an ester group and a terminal carboxylic acid group.

The diacyl halide is prepared by reacting the terminal carboxylic acid group of the ester-acid with an inorganic acid halide. Suitable halides include chlorine, bromine, fluorine and iodine. A specific inorganic acid halide is thionyl chloride. Other suitable inorganic acid halides include phosphorus oxyhalide such as phosphorus oxychloride and phosphorus oxybromide. Still other suitable halides such as phosphorus halides, i.e. phosphorus chloride, phosphorus bromide, and the like, are contemplated.

The diacyl halide is reacted with a source of phosphorus or source of phosphorus and an arylamine to produce the final product.

A suitable source of phosphorus is an organophosphite. The organo group of the organophosphite can be alkyl, aryl or alkaryl, specifically a diorgano or triorgano phosphite in which the organo group contains from 1 to 100 carbon atoms, preferably from 1 to 60 carbon atoms, more preferably from 1 to 20 carbon atoms. Specific examples of appropriate phosphites include dimethyl phosphite, trimethyl phosphite, diethyl phosphite, triethyl phosphite, dibutyl phosphite, tributyl phosphite, bis(2-ethylhexyl) phosphite, tris(2-ethylhexyl) phosphite, diphenyl phosphite, triphenyl phosphite and bis(nonylphenyl) phosphite, etc.

Suitable arylamines include primary and secondary aromatic amines, specifically, the aryl amines include dicyclic and tricyclic aromatic hydrocarbon groups which can contain alkyl substituents, specifically aromatic or alkylaromatic hydrocarbons which contain from 8 to 100 carbon atoms. Examples of hydrocarbons include naphthyl, nonylphenyl and octylphenyl. A representative example of the amine is an unsymmetric aromatic amine such as N-octylphenyl-1-naphthylamine or a symmetric aromatic amine such as diphenylamine.

The combination of the phosphite or the phosphite and the amine onto the diacylhalide backbone provides the basis for the internal synergistic properties of the molecule which enable the reaction products to exhibit antiwear and antioxidant properties and enhanced lubricity.

The hydrocarbon-substituted succinic anhydride is reacted with the alkoxylated amine in a molar ratio ranging from about 10 to 1, preferably 2 to 1 of anhydride to alkoxylated amine under conditions of ambient pressure, about 1 ATM, and at a temperature which falls within the range of about 0° C. to 250° C. (32° F. to 482° F.) for a time ranging from about 5 min. to 3 hrs., specifically from 30 min. to 2 hrs. until the ester-acid is formed. Thereafter, the inorganic acid halide is added, in a ratio ranging from about 5 to 1, specifically from 1.2 to 1 of ester-acid to inorganic acid halide, to the reaction mixture, and the conditions are maintained to obtain the acyl halide. The acyl halide is then reacted with an equal molar ratio of a source of phosphorus or a source of phosphorus and an amine to produce the final product. An excess, as well as less than molar amounts, of the source of phosphorus or source of phosphorus and amine can be used. A solvent or diluent may be included in the reaction mixture, suitable solvents include toluene, benzene and xylenes. Typically, a stepwise one pot procedure is followed in which the ester-acid is formed in step 1, the acyl halide is formed in step 2 and the source of phosphorus or source of phosphorus and amine are added in step 3. Step 3 is usually conducted at a reflux temperature and for a length of time sufficient for the final product to form, generally ranging from 1 hour to 24 hours, specifically from 2 hours to 6 hours.

The reaction products are blended with lubricants in a concentration of about 0,001% to 10%, preferably, from 0.5% to 2% by weight of the total composition.

The contemplated lubricants are liquid oils in the form of either a mineral oil or synthetic oil or mixtures thereof. Also contemplated are greases in which any of the foregoing oils are employed as a base.

In general, the mineral oils, both paraffinic and naphthenic and mixtures thereof can be employed as a lubricating oil or as the grease vehicle. The lubricating oils can be of any suitable lubrication viscosity range, for example, from about 45 SSU at 100° F. to about 6000 SSU at 100° F., and preferably from about 50 to 250 SSU at 210° F. Viscosity indexes from about 95 to 130 being preferred. The average molecular weights of these oils can range from about 250 to about 800.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

Where synthetic oils, or synthetic oils employed as the vehicle for the grease, are desired in preference to mineral oils, or in mixtures of mineral and synthetic oils, various synthetic oils may be used. Typical synthetic oils include polyisobutylenes, polybutenes, polydecenes, siloxanes and silicones (polysiloxanes).

The lubricating oils and greases contemplated for blending with the reaction product can also contain other additives generally employed in lubricating compositions such as co-corrosion inhibitors, detergents, co-extreme pressure agents, viscosity index improvers, co-friction reducers, co-antiwear agents and the like. Representative of these additives include, but are not limited to phenates, sulfonates, imides, heterocyclic compounds, polymeric acrylates, amines, amides, esters, sulfurized olefins, succinimides, succinate esters, metallic detergents containing calcium or magnesium, arylamines, hindered phenols and the like.

The additives are most effective when used in gear oils. Typical of such oils are automotive spiral-bevel and worm-gear axle oils which operate under extreme pressures, load and temperature conditions, hypoid gear oils operating under both high speed, low-torque and low-speed, high torque conditions.

Industrial lubrication applications which will benefit from the additives include circulation oils and steam turbine oils, gas turbine oils, for both heavy-duty gas turbines and aircraft gas turbines, way lubricants, gear oils, compressor oils, mist oils and machine tool lubricants. Engine oils are also contemplated such as diesel engine oils, i.e., oils used in marine diesel engines, locomotives, power plants and high speed automotive diesel engines, gasoline burning engines, such as crankcase oils and compressor oils.

Functional fluids also benefit from the present additives. These fluids include automotive fluids such as automatic transmission fluids, power steering fluids and power brake fluids.

It is also desirable to employ the additive in greases, such as, automotive, industrial and aviation greases, and automobile chassis lubricants.

EXAMPLES

The following examples, which were actually conducted, represent a more specific description of the invention.

Example 1

Approximately 106.4g (0.40 mol) of dodecenylsuccinic anhydride (DDSA), 50 ml of toluene and 70.4 g (0.20 mol) of bis(2-hydroxyethyl) oleylamine (commercially obtained from Akzo Chemicals, Inc. under the tradename Ethomeen 0/12) were charged to a stirred reactor equipped with a condenser, thermometer, nitrogen inlet and outlet, and stirred for one hour at 70° C. A solution of 52 g (0.44 mol) of thionyl chloride in 50 ml of toluene was then added in dropwise. The mixture was stirred for one more hour at 70° C. before addition of 77.6 g (0.40 mol) of dibutyl phosphite. The resulting mixture was heated to reflux temperatures for four hours and then filtered and evaporated under vacuum at 130° C. to yield 254 g of brown fluid.

Example 2

Under the same reaction conditions as described in Example 1, the diacyl chloride was generated from DDSA (53.2 g, 0.20 mol), Ethomeen 0/12 (35.2 g, 0.10 mol) and thionyl chloride (26 g, 0.22 mol). A mixture of N-octylphenyl-1-naphthylamine (33 g, 0.10 mol) and bis(nonylphenyl)phosphite (48.6 g, 0.10 mol) in 100 ml of toluene solution was then introduced and reacted for four hours at reflux.

EVALUATION OF THE PRODUCTS

Antiwear Properties

The ability of the oil containing the additives of the present invention to prevent the wearing down of metal parts under severe operating conditions was tested in the 4-Ball Wear Test. The results of the test are presented in Table 1. Following the standard ASTM testing procedure, the test was conducted in a device comprising four steel balls, three of which were in contact with each other in one plane in a fixed triangular position in a reservoir containing the test sample. The test sample was an 80% solvent paraffinic bright, 20% solvent paraffinic neutral mineral oil and the same oil containing about 1.0 wt % of the test additive. The fourth ball was above and in contact with the other three. The fourth ball was rotated at 2000 rpm while under an applied load of 60 kg and pressed against the other three balls, the pressure was applied by weight and lever arms. The test was conducted at 200° F. for 30 minutes.

The diameter of the scar on the three lower balls was measured with a low power microscope and the average diameter measured in two directions on each of the three lower balls was taken as a measure of the antiwear characteristics of the test composition. The table presents data showing the marked decrease in wear scar diameter obtained with respect to the test composition containing the product of the Examples.

TABLE 1

Four-Ball Test
(60 kg load, 2000 rpm, 30 min., 200° F.)

| Item | Wear Scar Diameter (mm) |
|---|---|
| Base Oil (80% solvent paraffinic bright, 20% solvent paraffinic neutral mineral oil) | 2.975 |
| 1% Example 1 in above base oil | 0.613 |
| 1% Example 2 in | 0.654 |

TABLE 1-continued

| Item | Four-Ball Test (60 kg load, 2000 rpm, 30 min., 200° F.) Wear Scar Diameter (mm) |
|---|---|
| above base oil | |

The results clearly show good antiwear activity by the products of the examples.

Antioxidant Properties

The reaction products were blended in a concentration of 1 wt % in a 200 second, solvent refined paraffinic neutral mineral oil and evaluated for antioxidant performance in the Catalytic Oxidation Test at 325° F. for 72 hours. The results are presented in Table 2.

In the Catalytic Oxidation Test a volume of the test lubricant was subjected to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;
2) 0.78 square inches of a polished copper wire;
3) 0.87 square inches of a polished aluminum wire; and
4) 0.107 square inches of a polished lead surface.

The results of the test were presented in terms of change in kinematic viscosity (ΔKV), change in neutralization number (ΔTAN) and the presence of sludge. Essentially, the low ΔKV meant that the lubricant maintained its resistance to internal oxidative degradation under high temperatures, the low ΔTAN indicated that the oil maintained its acidity level under oxidizing conditions.

TABLE 2

| Item | Catalytic Oxidation Text 72 hours at 325° F. Additive Conc. (wt %) | Change in Acid Number ΔTAN | Percent Change in Viscosity % ΔKV |
|---|---|---|---|
| Base Oil (200 second, solvent refined, paraffinic neutral, mineral oil) | — | 17.20 | 503.3 |
| Example 1 in above base oil | 1.0 | 5.24 | 55.7 |
| Example 2 in above base oil | 1.0 | 1.90 | 21.3 |

As shown above, the products of this invention show very good antioxidant activity as evidenced by control of increase in acidity and viscosity.

Copper Corrosivity

The effectiveness of the lubricant containing the additive of the instant invention to resist corrosion of copper was evaluated in the ASTM D 130 standard test method for the detection of copper corrosion from petroleum products by the Copper Strip Tarnish Test. Following the standard test method, a polished copper strip was immersed in a given quantity of a lubricant sample to be tested and heated at a temperature of 250° F. for 3 hours. At the end of the time period, the copper strip was removed, washed and compared to the ASTM Copper Strip Corrosion Standards. The standards are reproductions in color of typical test strips representing increasing degrees of tarnish and corrosion. The corrosiveness of the sample lubricant was interpreted as the appearance of the test strip agreed with one of the strips of the ASTM standards. The classification of corrosiveness ranged from 1 to 4, 1 representing slight tarnish and 4 representing actual corrosion. The results of the test were reported in Table 3.

TABLE 3

| Item | Copper Strip Corrosivity Test ASTM D 130, 250° F., 3 Hours Corrosivity Rating |
|---|---|
| Base Oil (200 second, solvent refined, paraffinic neutral, mineral oil) | 1a |
| 1% Example 1 in above base oil | 1b |
| 1% Example 2 in above base oil | 1a |

From the results of the test, it is apparent that the products of Examples 1 and 2 do not pose a problem of reactivity towards copper.

What is claimed is:

1. A lubricant composition comprising a major proportion of lubricant and a minor multifunctional antioxidant and antiwear amount of an additive product comprising the reaction product of a hydrocarbon-substituted diacyl halide, derived from a hydrocarbon-substituted succinic ester-carboxylic acid and a halogenating agent, a source of phosphorus or a source of phosphorus and an aryl or alkaryl amine, the hydrocarbon group of the hydrocarbon-substituted succinic ester-acid contains from about 1 to about 300 carbon atoms.

2. The composition of claim 1 in which the hydrocarbon-substituted succinic ester-carboxylic acid is derived from a reaction product of an alkoxylated amine and a hydrocarbon-substituted succinic anhydride, the hydrocarbon-substitued succinic anhydride is represented by the structural formula:

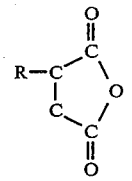

where R is a hydrocarbon group containing from about 1 to 300 carbon atoms.

3. The composition of claim 2 in which the hydrocarbon-substituted succinic anhydride is derived from a condensation reaction between dodecene and maleic anhydride.

4. The composition of claim 2 in which the alkoxylated amine is free of active amino-hydrogen atoms.

5. The composition of claim 2 in which the alkoxylated amine is represented by the structural formula:

$$R_2-\underset{\underset{(CH_2CHR_6O)_zH}{|}}{N}-R_3-\overset{\overset{(CH_2CHR_4O)_xH}{|}}{N}-(CH_2CHR_5O)_yH$$

where $R_2$ is a hydrocarbon group containing from about 1 to 100 carbon atoms, $R_3$ is a hydrocarbon group containing 3 to 25 carbon atoms, $R_4$, $R_5$ and $R_6$ are hydrogen or the same or different hydrocarbon group containing about 1 to 60 carbon atoms, x is an integer ranging from about 0 to 20, y is an integer ranging from about 0 to 20, z is an integer ranging from about 0 to 20, and x+y+z equals at least 1.

6. The composition of claim 2 in which the alkoxylated amine is represented by the structural formula:

$$R_2-\underset{\underset{(CH_2CHR_5O)_yH}{|}}{N}-(CH_2CHR_4O)_xH$$

where $R_2$ is a hydrocarbon group containing from about 1 to 100 carbon atoms, $R_4$ and $R_5$ are hydrogen, or the same or different hydrocarbon group containing about 1 to 60 carbon atoms, x is an integer ranging from about 0 to 20, y is an integer ranging from about 0 to 20, and x+y equals at least 1.

7. The composition of claim 5 in which the groups, represented by $R_2$, $R_3$, $R_4$, $R_5$ and $R_6$ are the same or different hydrocarbon groups selected from the group consisting of methyl, ethyl, propyl, butyl, isobutyl, pentyl, hexyl, heptyl, octyl, decyl, dodecyl, polymers and copolymers made therefrom.

8. The composition of claim 6 in which the groups, represented by $R_2$, $R_4$ and $R_5$ are the same or different hydrocarbon groups selected from the group consisting of methyl, ethyl, propyl, butyl, isobutyl, pentyl, hexyl, heptyl, octyl, decyl, dodecyl, polymers and copolymers made therefrom.

9. The composition of claim 1 in which the halogenating agent is an inorganic acid halide.

10. The composition of claim 9 in which the inorganic acid halide is thionyl chloride.

11. The composition of claim 1 in which the source of phosphorus is an organophosphite.

12. The composition of claim 11 in which the organophosphite is a diorgano or triorgano phosphite in which the organo group contains from 3 to 100 carbon atoms.

13. The composition of claim 12 in which the organo phosphite is dibutyl phosphite, tributyl phosphite, diphenyl phosphite, triphenyl phosphite or bis(nonylphenyl) phosphite.

14. The composition of claim 13 in which the alkaryl amine is N-octylphenyl-1-naphthylamine.

15. The composition of claim 1 in which the lubricant is a mineral or synthetic oil or a mixture thereof.

16. The composition of claim 1 in which the amount of the additive product ranges from 0.001 to 10 wt. % based on the entire weight of the composition.

17. The composition of claim 15 in which the lubricant is a grease made from a mineral oil or synthetic oil or mixture thereof and a grease thickener.

18. A process for making a product of reaction suitable for use as a lubricant additive comprising (1) reacting a hydrocarbon-substituted succinic anhydride with an alkoxylated amine which is free of an active amino-hydrogen to produce a hydrocarbon-substituted ester-carboxylic acid; (2) reacting the hydrocarbon-substituted ester-carboxylic acid with an inorganic acid halide to produce a diacyl halide; and (3) reacting the diacyl halide with a source of phosphorus or a source of phosphorus and an aryl amine or an alkaryl amine.

19. The process of claim 18 in which the hydrocarbon substituted succinic anhydride is dodecenyl succinic anhydride.

20. The process of claim 18 in which the inorganic acid halide is thionyl chloride.

21. The process of claim 18 in which the source of phosphorus is bis(nonylphenyl) phosphite or dibutyl phosphite.

22. The process of claim 21 in which the amine is N-octylphenyl-1-naphthylamine.

23. A method of reducing wear between relatively moving surfaces comprising contacting the relatively moving surfaces with a reaction product of a hydrocarbon-substituted diacyl halide, derived from a hydrocarbon-substituted succinic ester-carboxylic acid and a halogenating agent, a source of phosphorus or a source of phosphorus and an aryl or alkaryl amine, the hydrocarbon group of the hydrocarbon-substituted succinic ester-acid contains from about 1 to about 300 carbon atoms.

24. The method of claim 23 in which the hydrocarbon-substituted succinic ester-carboxylic acid is derived from a reaction product of an alkoxylated amine and a hydrocarbon-substituted succinic anhydride.

25. A lubricating additive product prepared by a process comprising (1) reacting a hydrocarbon-substituted succinic anhydride with an alkoxylated amine which is free of an active amino-hydrogen to produce a hydrocarbon-substituted ester-carboxylic acid; (2) reacting the hydrocarbon-substituted ester-carboxylic acid with an inorganic acid halide to produce a diacyl halide; and (3) reacting the diacyl halide with a source of phosphorus or a source of phosphorus and an aryl amine or alkaryl amine.

* * * * *